United States Patent [19]

Sloan et al.

[11] Patent Number: 4,680,817

[45] Date of Patent: Jul. 21, 1987

[54] COMPACT PERSONAL HYGIENE CENTER

[76] Inventors: George C. Sloan, 28 Dixon Avenue, Toronto, Ontario M4L 1N3; David J. Laine, 1868 Queen Street East, Toronto, Ontario M4L 1H2, both of Canada

[21] Appl. No.: 880,145

[22] Filed: Jun. 30, 1986

[51] Int. Cl.[4] ..... A47K 4/00; E03C 1/01

[52] U.S. Cl. ..... 4/663; 4/312; 4/556; 4/560; 4/578; 4/590

[58] Field of Search ..... 4/663, 664, 312, 465, 4/546, 555, 556, 557, 560, 568, 571, 573, 578, 579, 584, 589, 590, 597, 604, 467, 300, 420; 297/14, 107

[56] References Cited

U.S. PATENT DOCUMENTS

| | | | |
|---|---|---|---|
| 2,145,435 | 1/1939 | Smith | 4/312 |
| 2,198,853 | 4/1940 | Andersen et al. | 4/312 |
| 2,202,486 | 5/1940 | Fredrickson et al. | 4/312 |
| 2,907,048 | 10/1959 | Gould | 4/597 |
| 3,719,960 | 3/1973 | Russell | 4/556 |
| 3,863,275 | 2/1975 | Brendgord et al. | 4/556 |

*Primary Examiner*—Stephen Marcus
*Assistant Examiner*—Linda J. Sholl
*Attorney, Agent, or Firm*—Sim & McBurney

[57] ABSTRACT

A personal hygiene center comprises in combination a tub, hand-held shower head mounted on the tub and toilet. The tub has upright front and rear walls and opposing end walls. A ceiling interconnects the walls and is of a height to accommodate a normal person standing on a floor of the tub. The tub has a walk-in entrance opening in the front wall. The door closes off a lower portion of the front wall to contain water in the tub and leave open an upper portion of the front wall to permit access into the tub by an attendant. A bench-style seat is integral with a first of the end walls. A cavity is defined beneath the bench seat where the opening exposes a major portion of an edge of the bench-style seat adjacent the front wall. A second opening is provided in the front wall to permit sliding movement of the toilet into and out of the cavity. Track means mounts the toilet beneath the bench seat for such sliding movement into and out of storage position. The toilet, when in an extended use position outwardly of the front wall, provides a transfer point for a person moving from outside the tub through the opening onto the bench seat. The hand-held shower head is mounted on the second end wall and is connected by a length of flexible hose sufficient to extend the hand-held shower over to the toilet.

12 Claims, 8 Drawing Figures

FIG. 7.
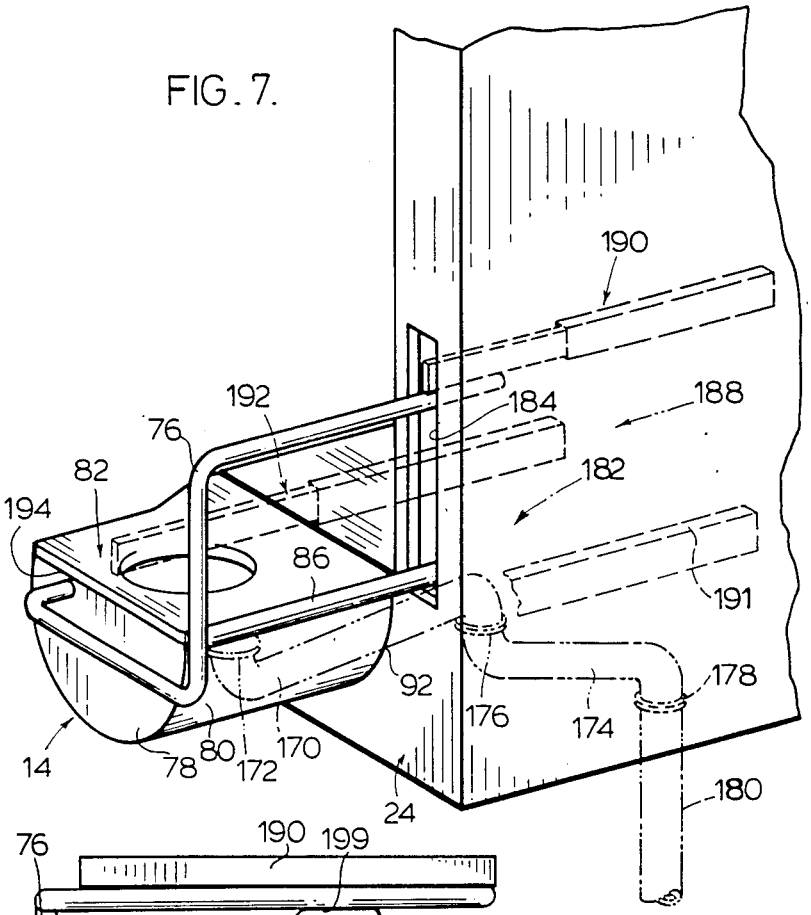
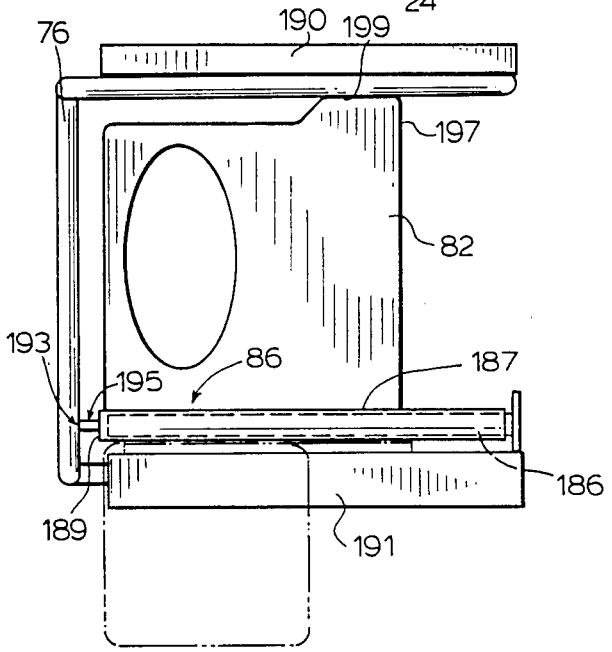
FIG. 8.

COMPACT PERSONAL HYGIENE CENTER

FIELD OF THE INVENTION

This invention relates to a compact bathroom construction which provides for all personal hygiene needs in a manner which also readily accommodates the handicapped, frail or people having locomotive difficulty.

BACKGROUND OF THE INVENTION

The population growth coupled with improved health services has resulted and will continue to result in an ever increasing number of individuals who, through the frailties occasioned by aging or some temporary or permanent handicap, continue to live and to require either special care or special facilities to accommodate them. The same two factors have and will continue to exert economic pressure on the globe's limited resources, requiring societies to be more efficient with space. The typical bathroom in use today is larger than necessary, unable to accommodate safely the frail or handicapped, and is very often inaccessible being located on floor levels other than those upon which the user spends most time. The individual components of today's bathroom, even when the bathroom can be accessed, are inadequate to the needs of the frail and handicapped. The conventional tub, as Russell notes in his U.S. Pat. No. 3,719,960, sits on the floor with vertical upstanding side walls. The user must step over a wall and then sit down in the tub. While this procedure is safe for a normal person, it is extremely difficult for the physically limited or frail. Egress is just as difficult. The typical toilet is almost always so placed as to be inaccessible to the wheelchair bound. The typical toilet is also almost always too low for the frail or handicapped, making sitting and standing back up an unwelcome adventure. The typical bathroom has the toilet and bathtub in the same room but not so arranged as to be accessed one from the other. This limits the potential use of both as well as presenting a new difficulty when the user desires to use both in sequence.

To reduce the danger inherent in the typical bathtub, the provision of a door in a tub with a seat-height horizontal section extending from one wall has been suggested in a number of patents: U.S. Pat. No. 3,719,960, Russell; U.S. Pat. No. 4,118,810, Brickhouse; and U.S. Pat, No. 3,863,275, Brendgord et al. All afford improved safety over conventional bathtubs. The bathtub system disclosed in Russell, U.S. Pat. No. 3,719,960 provides for an entrance opening through a side of the tub which exposes part of the seat molded into the tub to enable the user to sit directly onto a portion of the seat as they transfer themselves from outside to inside the tub. The entrance opening extends to the bottom of the tub so that, as a person transfers into the tub, there is no need to step up over any tub side wall portions. Brickhouse, U.S. Pat. No. 4,118,810, contemplates a similar tub arrangement where the door for the entrance opening is removably hinged to the tub wall in providing free access to the tub interior without interference with an open door. U.S. Pat. No. 3,863,275 discloses adapting a similar type of tub with the provision for a hand-held shower head which can be used in combination with the bath water contained in the tub for personal hygiene. In these systems, fairly complex arrangements are provided for locking the door in the closed position to resist outward pressures of water contained in the tub.

Provisions have been made in the past for stand alone compact bathroom units, such as may be found in areas of limited space including trains and airplanes, or small size apartment units. U.S. Pat. No. 2,907,048 discloses a preassembled bathroom unit which includes a shower with toilet and sink mounted on an outside wall thereof and a hinged bench on an opposite wall of the shower. A permanently mounted shower head is provided interiorly of the shower walls. However, no consideration has been given in this design to the handicapped or frail. The shower enclosure requires stepping over a lower shower wall where the toilet is located completely independently of the shower entrance way. Another attempt in providing a combination bathtub/shower is disclosed in Canadian Pat. No. 1,000,902. A molded seat is provided in a corner of the tub portion with the opposite corner including entrance doors which are received in pocket portions of the tub wall. The seat is, therefore, located opposite the door entrance making it very difficult for the handicapped or frail to enter the tub area and be immediately seated.

Toilet constructions have been contemplated in combination with a bathtub, such as disclosed in U.S. Pat. No. 4,112,524. The toilet arrangement is provided within the bathtub and has the obvious drawbacks of sanitation even though provisions are made in the tub to deal with this problem.

In limited or cramped space, provision has been made for toilet constructions which provides for a use position and a stored position, such as disclosed in Canadian Pat. No. 457,576. The water closest is swung from a stored position against a back wall to an outward extended use position. Canadian Pat. No. 1,064,651 discloses a combination sink and toilet arrangement with the sink pivotally mounted above the toilet. The toilet seat is mounted on a track which permits movement of the seat portion relative to the water closet, from a stored position to a use position which functions in combination with the use of the sink. Another type of swing out water closet arrangement is disclosed Canadian Pat. No. 1,079,002. The water closet is stored in a cabinet. The cabinet doors may be opened and the water closet pivoted outwardly to the use position. However, such swing mountings for the toilet seat require considerable space compared to the overall size of the water closet.

SUMMARY OF THE INVENTION

According to an aspect of the invention, a personal hygiene centre comprises in combination a tub, hand-held shower head mounted on the tub and a toilet. The tub has upright front and rear walls and opposing end walls. A ceiling interconnects the walls and is of a height to accommodate at least a normal person's height. The tub has a walk-in entrance opening in the front wall with a door closing off the lower portion of the front wall entrance opening to contain water in the tub and leave open an upper portion of the front wall entrance opening to permit access into the tub by an attendant standing outside of the tub. A bench-style seat is integral with a first of the end walls with a cavity being defined beneath the bench seat. The opening exposes a major portion of an edge of the seat adjacent the front wall. A second opening is provided in the front wall to permit sliding movement of the toilet into and out of the cavity. Means is provided for mounting the toilet beneath the bench seat for movement into and out of the storage position beneath the bench-style seat. The toilet, when in an extended use position outwardly of the front wall, provides a transfer point for a person moving in from outside the tub through the opening onto the bench seat. The hand-held shower head is mounted on a wall and is connected to a source of water on the second end wall by a length of flexible hose. The hose is of sufficient length to extend the hand-held shower head over to the toilet.

According to another aspect of the invention, a personal hygiene centre comprises in combination a compact arrangement of a bathtub and a toilet. The bathtub comprises a tub having a door entrance through a front wall of the tub. A seat with back rest extends across the tub and abuts the front wall. The door entrance comprises an opening in the front wall which provides access to within the tub. A cavity is defined in the tub beneath the seat. The toilet comprises a toilet bowl with means provided for mounting the toilet bowl for movement into and out of a storage position within the cavity beneath the seat. The door opening defines a front wall edge portion which follows generally an outline of the tub seat and back rest. A door is provided for closing the opening and means is provided for sealingly engaging the door with the front wall when the tub is to contain bath water.

BRIEF DESCRIPTION OF THE DRAWINGS

Preferred embodiments of the invention are shown in the drawings wherein:

FIG. 7 is a perspective view of a rear section of the tub and the track system for supporting the toilet in the extended use position; and FIG. 8 is a rear view of the toilet in the extended use position showing details of the seat hinge mechanism.

DETAILED DESCRIPTION OF THE PREFERRED EMBODIMENTS

Figure 1:
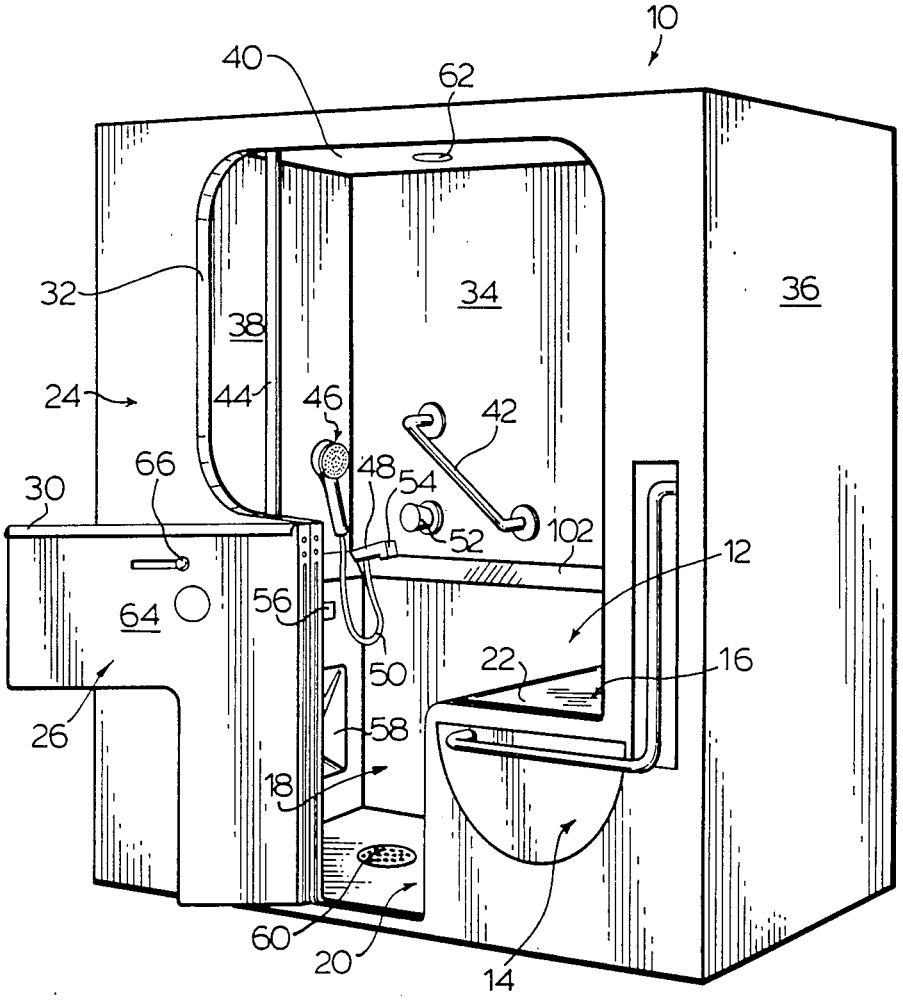
FIG. 1 is a perspective view of the personal hygiene centre according to a preferred embodiment of the invention.

A personal hygiene centre 10, as shown in FIG. 1, comprises in combination a bathtub 12 and a toilet 14 stowed beneath the bench-style seat 16 of the bathtub. An entrance opening 18 is provided to permit a person to move freely into and out of the tub 12. The entrance 18 extends downwardly to the tub floor 20 and follows the contour of the seat 16 to expose a seat edge portion 22 to facilitate entrance to the tub. The tub front wall 24 has the entrance opening 18 formed therein where a door 26 is hinged to the front wall by a stainless steel piano-style hinge. Above the door upper edge 30 is an enlarged portion for the entrance opening 32. Upper door edge 30 may include a downwardly curved splash rail. This permits an attendant standing outside of the hygiene centre to reach over the door edge 30 and to attend to the user's needs who is seated on the seat 16.

The tub has a back wall 34 and opposing first and second end walls 36 and 38. The walls terminate in a ceiling 40 which is spaced sufficiently from the floor 20 to accommodate the height of a normal person standing on the floor 20.

To assist the user in moving into and out of the tub 12, and raising and lowering from the seat 16, grab bars are strategically located on the tub walls. A grab bar 42 is secured to wall 34 and slopes downwardly towards the seat 16. A vertical grab bar 44 is connected to the front wall 24 to enable a person to pivot in and out of the tub through the entrance 18 while holding the grab bar 44. Mounted on the second wall 38 is a hand-held shower head 46 which is mounted to the wall and is connected to a water supply 48 by a length of flexible hose 50. The water supply to the shower head 46 is controlled by valve 52. In accordance with standard procedure, the valve 52 may have a temperature regulator to ensure that the water emerging from the water spout 54 or the shower head 46 is at the correct temperature so as to be comfortable for the user. An overflow for the tub is provided at 56 to ensure that the water level does not go above the door and cause water damage to the surrounding area. With the user seated on the bench 16, when desired, the feet may be elevated slightly and rest on the foot rest 58 molded in the second wall 38. Although not shown, a drain valve for the drain 60 is provided which controls the water level in the tub 12. When desired the drain valve may be released to allow water to escape from the tub through the drain 60.

To provide for additional comfort while seated within the tub 12, a light 62 is provided in the ceiling 40. The light may be of the standard white light type or have the facility to act as a heat lamp to warm the area within the tub. In addition to a heat lamp, suitable vents may be provided about the perimeter of the walls and an air heater used to blow hot air into the tub area and circulate the hot air to increase the comfort level while the user is in the tub. When the person is seated on the bench 16, the control 52 is conveniently located to operate the water supply. In addition, the controls for locking the door 26 in the closed position are conveniently located along the inside surface 64 of the door. A lever 66 is provided which may be slid rearwardly to lock the door in the closed position. This slide functions in a manner to be discussed in more detail with respect to FIG. 4.

Figure 2:
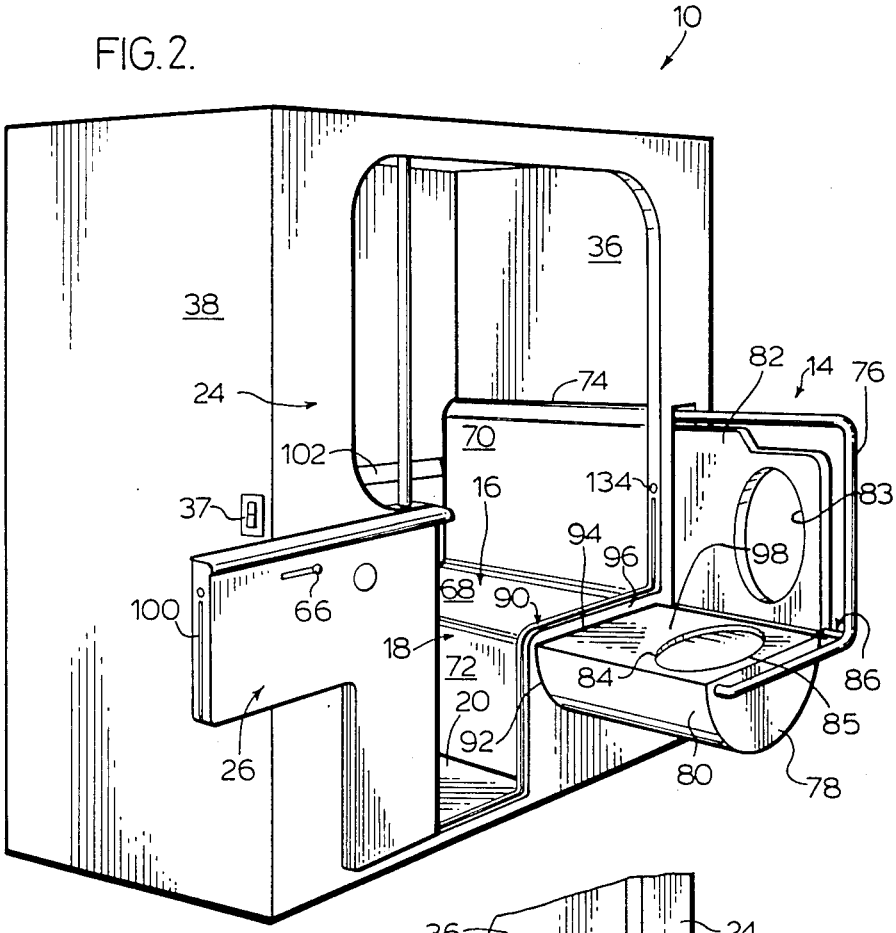
FIG. 2 is a perspective view of the personal hygiene centre of FIG. 1 with the toilet extended to the use position.
Figure 3:
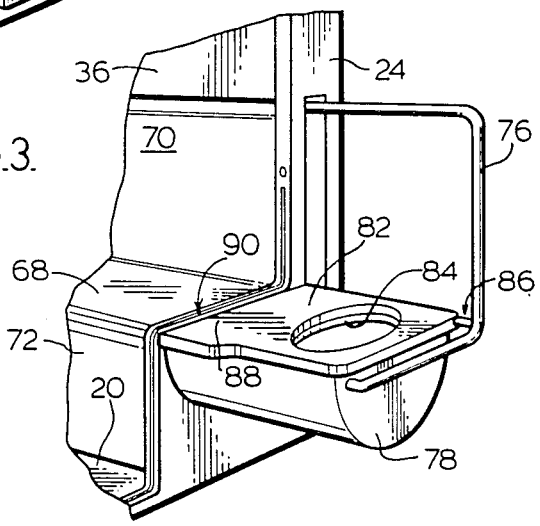
FIG. 3 is a perspective view of a portion of the personal hygiene centre of FIG. 2 with the toilet seat in the lowered position.

As shown in FIG. 2, the bench-style seat 16 has a seat portion 68 with back rest 70. Skirt 72 is provided beneath the seat portion 68 where the skirt 72 sealingly engages the floor 20. The upper edge 74 of the back rest 70 sealingly engages the end wall 36. According to a preferred embodiment of this invention, the seat 16 may be integral with the rear wall 36. A cavity is defined beneath the seat 68 and behind the back rest 70 to accommodate the toilet 14 in the stored position, as shown in FIG. 1. A grab bar 76 is attached to end plate 78 of the toilet housing 80. By pulling on the grab bar 76, the toilet, which is mounted on a track system to be discussed with respect to FIG. 7, is moved outwardly of the cavity beneath the seat to its extended use position. The toilet seat 82 is pivotally mounted on the grab bar 76 at 86 in the manner to be discussed with reference to FIG. 8. The toilet seat is in the raised position when stored in the cavity behind the back rest 70 of the seat 16. With the toilet in the extended use position, the toilet seat 82 may be lowered onto the toilet bowl 84 to support the toilet seat in the horizontal position. The toilet seat 82 has an enlarged oval-shaped opening 83 to register with corresponding shaped opening 85 in toilet bowl 84. The toilet seat 82 includes an enlarged support area 88 adjacent the front wall edge 90 which follows the outline of the seat 68. According to this preferred embodiment, the toilet seat enlarged support area 88 and the seat 68 lie essentially in the same plane. The front wall edge 90 is also in essentially the same plane so that one may transfer smoothly from the toilet seat onto the bathtub seat 68 without any difficulty. By storing the toilet seat 82 in the raised position, the opening 92 for the cavity has an upper edge 94 which is below the front wall edge 90 a distance which is essentially the same as the thickness of the toilet seat 82. This thickness of the front wall portion 96 is sufficient to permit the upper planar top 98 of the toilet bowl to slide beneath the seat 68 without interfering with same. This is particularly practical where the tub seat 68 is integrally molded with the end wall 36, all of which may be constructed from a reinforced fiberglass, acrylic or like synthetic material commonly used in the molding of tubs and shower stalls.

The entrance 18 in the front wall 24 is in essence L-shaped to follow the contour of the skirt 72, the seat 68 and the back rest 70. According to this preferred embodiment, this arrangement exposes the entire seat area 68 and the back rest 70 to give maximum room in which a user may transfer from the toilet seat 82 onto the seat 68. The door 26 is of corresponding inverted L-shape having a seal around its edge 100 which sealingly engages the front wall edge 90 to define the L-shaped opening against which the door edge is sealed. This is discussed in more detail with respect to FIGS. 4 through 6.

In accordance with this invention, the handicapped, invalid, frail or people having locomotive problems may approach the hygiene centre 10 in a wheelchair, or other transport assisting device and extend the toilet 14 to its use position. By lowering the user onto the toilet seat 82, the user can then usually transfer themselves onto the seat 68 of the tub. By having the toilet extend outwardly of the front wall 24, movement from a transport assisting device or wheelchair is very easy and can be assisted by an attendant. The entrance opening 18 is formed in the front wall 24 to permit this transfer from the toilet onto the seat 68 of the tub, while at the same time the arrangement provides for a compact hygiene centre where the toilet is stowed beneath the bench-style seat 16 of the tub when not in use. Such storage of the toilet enhances the overall appearance of the hygiene centre. Although in accordance with this preferred embodiment of the invention in providing a toilet seat which is essentially at the same level as the seat portion 68 of the tub, it is apparent that the advantages of the invention can still be realized by providing a toilet arrangement which is not at the same level as the bench seat in the tub. For example, the toilet may have the seat portion resting on top of the toilet bowl as it is stowed in its entirety beneath the seat of the tub. Alternatively, the toilet bowl may be shaped in a manner to avoid the need for a toilet seat which could also be stowed directly beneath the seat portion of the bench-style seat and hence when in the extended use position, is at a level different from the level of the seat portion 68. All of these arrangements, however, have in common that, when the toilet is in the extended position, it provides a transfer point for one moving from a wheelchair or the like onto the bench of the tub.

The overall dimensions of the hygiene centre may be approximately 1.7 meters wide by 0.75 meters deep and approximately 2 meters high. This defines a volume of approximately 100 gallons in the tub, assuming that one wishes to provide a water level just below overflow outlet 56 about the perimeter of walls 24, 34 and 38. In order to reduce the water volume in the tub, it is possible to shape regions of the walls which are not touched by the user to extend outwardly into the tub area, thereby further reducing the volume of water required to fill the unit to a level defined by overflow 56. For this height of water in the tub which is normally slightly less than one meter, a suitable seal is provided about the door edge 100 to seal the door against the front wall edge 90 which defines the entrance opening 18. A safety device may be provided which precludes filling of the tub until the door is properly, mechanically locked in place and the seal about the door edge adjacent the front wall edge is completed.

Figure 4:
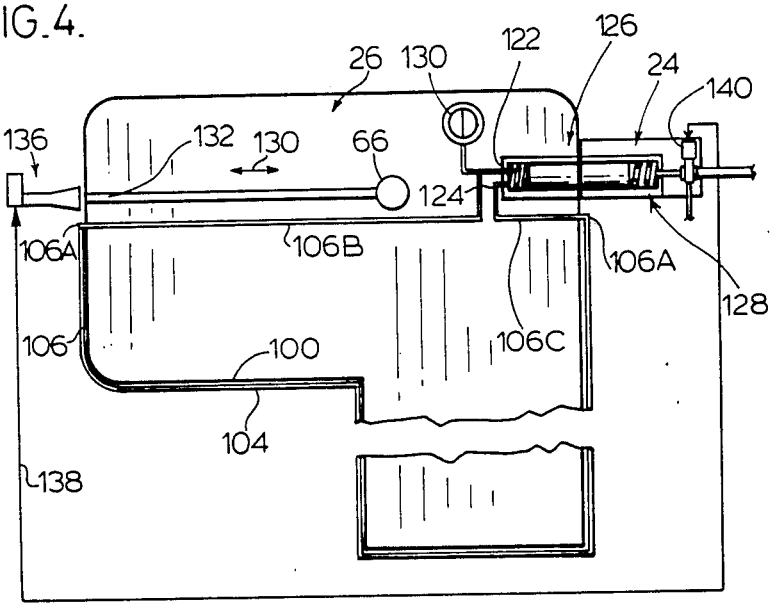
FIG. 4 is a plan view of the door side showing the mechanism for sealing the door edge.
Figure 5:
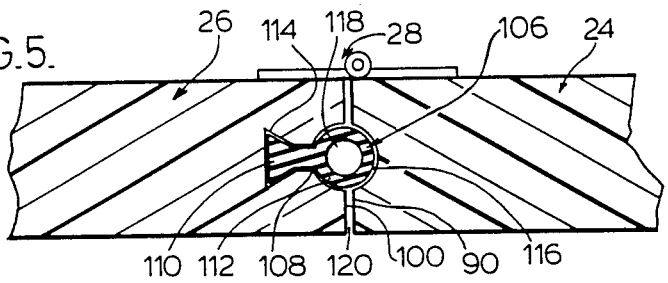
FIG. 5 is a section through an edge of the door and the tub side wall showing the sealing device.

With reference to FIG. 4, the door 26 has a sealing device 104 about a portion of its edge 100 which is opposite the front wall edge 90. According to this embodiment, the sealing device is a tube 106. As shown in FIG. 5, the tube 106 in cross-section has an annular wall 108 with integral flared rib portion 110. The door 26 includes a groove 112 formed in the edge 100 to receive the tube ribbing 110 and connected in place in the undercut 114 of the groove 112. A stainless steel piano-style hinge 28 is connected to the front wall 24 and the door 26 to permit the door to be opened and swung completely around against the front wall 24. With the door in the closed position, the tube 106 fits into a groove 116 formed in the edge 90 of the front wall 24. When the tube side wall 108 is expanded by forcing pressurized fluid into the cavity 118 of the tube, the tube side wall 108 expands to fill the opposing grooves 112 and 116 to seal from the interior the space 120 between the door edge 100 and the front wall edge 90.

As shown in FIG. 4, the tube 106, as it follows the outline of the door edge 100, rises on each side of the door to a level indicated at **106*a*. The tube then extends through the door and via branch-tube lines 106*b* and 106*c* and is connected to respective outlets 122 and 124 of a device 126 which forces the pressurized fluid into the tube lines 106*b* and 106*c* to expand the tube 106 about the perimeter of the door to form the desired seal. The front wall 24 includes an actuator device 128 for actuating the device 126 to force pressurized fluid into the tube lines 106*b* and 106*c*. When sufficient pressure in the tube has developed to form the seal, a visual indicator 130 signals that the door is properly sealed and filling of the tub with water may commence. The visual/tactile indicator 130** may include a movable shield system which indicates red when the door is not properly sealed and indicates green when the door is properly sealed. The surfaces of the red and green indicator may have distinctly different surface texture so that the visually impaired can determine the state of the door seal.

Figure 6:
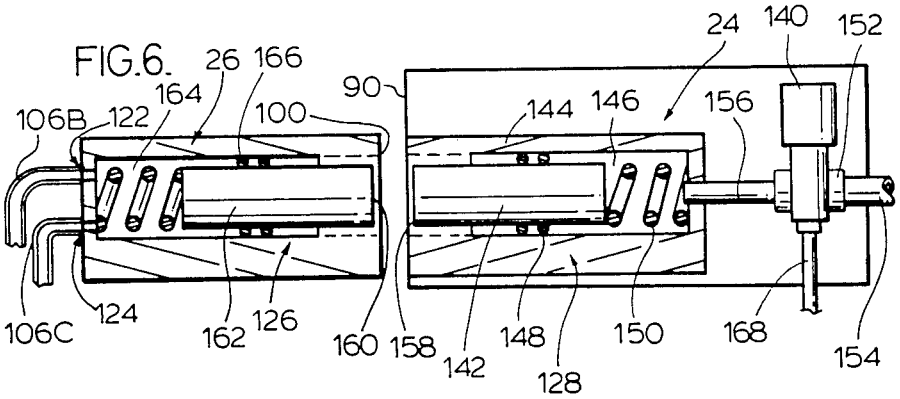
FIG. 6 is a section through the door seal actuating device.

A mechanical slide bolt 66 is mounted in the door 26 for reciprocal movement in the direction of arrow 130. When the door is closed, the slide lock 66 is moved in the direction away from the hinge area to extend the bolt portion 132 outwardly of the door edge 100 and into the bore 134 of the front wall edge 90, as shown in FIG. 2, to mechanically lock the door closed. At the base of the bore 134 in the front wall is a microswitch 136 which, when depressed, completes an electrical circuit from microswitch 136 through line 138 to solenoid 140 which controls actuation of device 128 to effect expansion of the sealing tube 106. As shown in FIG. 6, the actuator device 128 comprises a piston 142 mounted for reciprocal movement in a cylinder 144. A sealed cavity 146 is defined in the cylinder by sealing rings 148. A return spring 150 is provided in the sealed cavity 146 and is connected to the piston 142 to retract the piston 142 to the position shown in FIG. 6, when the cavity 146 is not pressurized. The solenoid 140 controls a valve 152 for pressurized water inlet line 154 connected to a source of pressurized water, which is normally at pressure in the range of 30 to 80 psi. When the microswitch 136 is depressed to send a signal via line 138, the solenoid 140 opens the valve 152 to a first position which permits the pressurized water to enter the sealed cavity 146 via line 156. This forces the piston 142 outwardly of the front wall edge 90 through an opening at 158 of front wall edge 90 and through the opening 160 of the door edge 100 into the device 126. The piston 142 has sufficient travel to move a plunger 162 inwardly of a sealed cavity 164. The sealed cavity 164 may contain a non-compressible fluid, such as hydraulic oil. By the piston 142 moving the plunger 162, oil is forced out of the outlets 122, 124 into the tubes **106*b* and 106*c* to expand the tube 106 about the perimeter portion 100 of the door. The plunger 162 is sealed in the cavity 164 by seals 166. The valve 152 remains open while the microswitch 136 is depressed to maintain the water pressure in cavity 146 which holds the piston 142 against the plunger 162 to maintain the oil pressure and thereby expansion of the sealing tube 106** about the door edge.

After use of the tub has been made and water is drained from the tub, the user may then push the mechanical latch 66 forwardly of the door to release the microswitch 136, which moves the solenoid 152 to a second position shutting off the water pressure and allowing water to drain from the cavity 146 via line 156 to a drain line 168. A safe, reliable seal for the door edge is, therefore, provided. It is possible to include a sensing means in association with device 126 which would electrically sense when the tube has been expanded sufficiently to form the seal. The sensing device could in turn control the water supply in association with valve 52 so that the user could only turn water on when the door is properly closed and sealed. However, it is appreciated that this would be optional, since in most situations the user would be capable of simply inspecting the visual indicator 130 and proceeding with filling of the tub when it is indicated that the door has been properly locked and sealed.

With reference to FIG. 7, the operation of the toilet 14 becomes apparent. The housing 80 contains the toilet bowl to which drain waste pipe 170 is connected to lead the waste away from the toilet bowl. The pipe 170 is pivoted at junction 172 to the toilet bowl. A second piece of pipe 174 is pivotally connected at 176 to pipe 170. At the other end, pipe 174 is pivotally connected at 178 to sewer waste line 180. Pipe 170, 174 pivots about the connections 172, 176, 178 constituting an extendable and retractable pipe section. Although not shown, a proper P-trap is included in the toilet 14 in accordance with standard plumbing techniques. Although not shown, a standard regulated hydraulic flush valve may be positoned in cavity 188 behind the back rest 70. This flush system uses a minimum of water and requires a minimum of space. The toilet flush may be actuated hydraulically by a button or lever located on a convenient spot either on the bar 76 or on the front side wall 24. A flexible conduit or the like leads from the flush valve to the toilet bowl.

The cavity 182 beneath the seat 68 is generally designated 182 with the opening 92 in the front wall 24. The opening 92 is independent of a second opening 184 in the front wall. The toilet seat is pivotally mounted on grab bar 76 by bar and tube arrangement 86. With the toilet seat in the raised position, the housing moves into the cavity 182 through opening 92, while the raised seat 82 moves into the cavity generally designated 188 behind the back rest 70 through the opening 184. The toilet housing 80 is suspended in an cantilever manner from within the cavity 182 by way of track devices 190, 191 and 192 which are secured to the framework behind and under the bench-style seat 16 which defines the cavity 182. Tracks 190, 191 and 192 may be of the roller bearing type which are designed to support considerable weights in a cantilever manner. Tracks 191 and 192 are secured to the housing interior so as not to be visible when the toilet is extended. The other track 190 is secured to the grab bar 76. The grab bar 76 is secured at 194 to the side 78 of the housing 80. In this manner, the toilet is supported in a cantilever manner in the extended use position as shown in FIG. 7. The waste lines are not visible to the user, nor are the supporting tracks to provide an overall asthetically appealing appearance when the toilet is in the extended use position. It is appreciated that such cantilever support has to be sufficient to accommodate the weight of exceptionally heavy people, since the toilet not only serves the bodily functions, but is also used as a transfer point for people moving into the tub area through the door entrance 18.

As shown in FIG. 8, the toilet seat 82 is pivotally mounted on the grab bar 76 by a tube and bar pivotal system generally designated 86. The bar 186 is secured to the interior of the bathtub housing. A tube 187 is telescopically mounted on the bar 186 and has a closed end at 189. The closed end 189 includes a pin 195 which is pivotally mounted to the end 189 and is secured at 193 to the grab bar 76. When it is desired to extend the toilet to the use position, the grab bar is conveniently located to permit manual sliding of the toilet outwardly to the use position. As the toilet is slid outwardly, the tube 187 slides over the bar 186. The toilet seat 82 is secured to the tube 187 so that the toilet seat travels outwardly with the grab bar 76. When the toilet is fully extended, the toilet seat inner edge 197 clears the exterior of the front wall 24 to permit lowering of the seat to the use position shown in FIG. 2. In this manner the opening 184 may be independent of the opening 92 for access to the cavities behind the seat and back rest. This permits location of supporting members between the openings 92 and 184 to rigidify the construction in that area. If desired, the upper edge 199 of the toilet seat may have a clip or other similar form of detent means for engaging the grab bar 76 to locate the toilet seat in the raised position for storage in the cavity behind the bench-style seat back rest 70.

It is appreciated that alternative techniques may be employed to mount the toilet for movement into and out of the storage position beneath the bench-style seat of the tub. In alternative mounting arrangements, it is also appreciated that the toilet seat may be hinged directly to the toilet bowl. This may be particularly suitable when the toilet bowl is mounted on a platform having wheels which would ride along the floor on which the hygiene centre rests. The grab bar may still be connected to the toilet bowl and by pulling on the grab bar, the toilet bowl on wheels rolls outwardly from beneath the bench-style seat. An appropriate stop device may be located to prevent pulling the toilet bowl away from the hygiene centre. Alternatively, the toilet bowl may be pivotally mounted on the framework of the tub such that the toilet bowl is pivoted from a storage position beneath the bench-style seat to a use position extending outwardly of the front wall and in line with the seat portion of the bench-style seat.

The hygiene centre, as described therefore, provides a bathing system in combination with a toilet in a compact manner. The hand-held shower head 46 is connected by a sufficient length of flexible hose 50. The shower head may be extended out to the toilet 14 to provide for personal cleaning after use of the toilet. In addition, such added length of flexible hose 50 permits an attendant outside the tub region to extend the shower head 46 over to the seat area to permit proper cleansing of a person's back and head.

It is appreciated that a sink may be mounted on the exterior of wall 38. The sink may be of the type which permits access by people in a wheelchair with appropriate side cabinets for toiletries and the like. Also provided on the exterior of wall 38 is the lightswitch 37 which controls the ceiling light 62.

Accordingly, the invention provides a larger door opening permitting an unimpeded access to the enclosure, yet defines an enclosed space for showers and baths dispensing, thereby, with the need for a special room to house the hygiene centre. The toilet acts as a built-in slide device which can be used to access the bench-style seat. One can slide readily from a wheelchair onto the toilet and then transfer into the tub. The hygiene centre has improved safety, compactness and accessibility for the frail or the handicapped, as well as those dwelling in accommodation where space it is a premium, such as smaller apartment units. In view of the hygiene centre being fabricated from reinforced fiberglass or acrylics, units become semi-portable and due to its semi-portable nature, it can be located in any desired readily accessible area. By the bringing together of the tub, the hand-held shower with hosing, and the toilet which toilet serves also as a slide into the tub and as a bidet-like station for peritoneal and/or chiropodal cleansing, there is an increased utility, synergism, and respect for the user's needs and limitations in the use of the unit. The door opening is of a shape to permit the user to either step directly into the tub or to sit directly on the seat height horizontal extension of the toilet or to slide onto the seat height horizontal extension of the toilet from a wheelchair, and then slide onto the bench-style seat from the toilet/slide/bidet station, or to be guided into the enclosure or onto the toilet by an attendant.

In view of the portable nature of the unit and its compact arrangement, it may be set up in many homes where the frail or handicapped are reluctant to sell their home to move into a dwelling which is designed especially for the handicapped. The system may be positioned on the floor in which the person lives and can be curtained off to provide a degree of privacy on that particular floor. This becomes very important when it is estimated that 7% of the population cannot use conventional bathrooms, safely or comfortably because they are in one way or another disabled. No longer do the frail or handicapped have to cope with conventional tubs which are difficult or almost impossible to enter and egress without the presence of an assistant.

The system albeit of compact nature is designed in a manner so as to be easily manufactured and readily maintained. The system can be crated to provide for transport and easy movement into and out of most homes and workplaces. When required the system could be formed in three different sections, namely the lower tub region, the mid-section and the ceiling section which readily fit through most door access areas to homes, apartments and workplaces.

Although preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. A personal hygiene centre comprising in combination a compact arrangement of a bathtub and a toilet, said bathtub comprising a tub having a door entrance through a front wall of said tub, a seat having a back rest extending across said tub and abutting said front wall, said door entrance comprising an opening in said front wall providing unimpeded access to within said tub and onto said seat, a cavity being defined beneath said seat, means for mounting said toilet for movement into and out of a storage position within said cavity, said toilet comprising a toilet bowl and a toilet seat, means for mounting said toilet seat for movement from a raised position to a lowered position on said toilet bowl, said cavity being defined behind said back rest in addition to being defined beneath said seat, said toilet bowl being connected to said mounting means for movement with said toilet seat in said raised position into and out of a storage position within said cavity beneath said seat and behind said back rest, said mounting means being a track system to which said toilet bowl is secured, said tub having a framework to which said track system is connected, said track system providing cantilever support for said toilet in said extended use position, said door opening defining a front wall edge portion which follows generally an outline of said tub seat and back rest, a door for closing said opening and means for sealingly engaging said door with said front wall when said tub is to contain bath water.

2. A personal hygiene centre of claim 1, wherein said toilet seat in said lowered position on said toilet bowl which is in an extended use position, is approximately level with said tub seat.

3. A personal hygiene centre of claim 2, wherein an upper surface of said tub seat and of said toilet seat lie generally in the same plane, said front wall edge portion lies generally in the same said plane.

4. A personal hygiene centre of claim 1, wherein said bathtub includes a hand-held shower head on a flexible hose, said hose being of sufficient length to extend said shower head out to said toilet.

5. A personal hygiene centre of claim 1, wherein a housing is provided for said toilet bowl, said housing being secured to said track system, said housing having an end wall which is essentially flush with said front wall when said toilet is stored in said cavity, said toilet seat having an enlarged hand support portion alongside said side wall edge portion.

6. A personal hygiene centre of claim 5, wherein a grab bar is connected to said housing end wall, said grab bar extending along said end wall, upwardly above said toilet seat and inwardly of said cavity behind said back rest, said grab bar being secured to a track member of said track system connected to said framework with said cavity, second and third track members being secured to said housing and being connected to said framework beneath said tub seat in said cavity, said toilet seat in said raised position engaging said grab bar to locate said toilet seat for storage in said cavity.

7. A personal hygiene centre of claim 2, wherein said door opening is essentially flush with a floor in said tub, said door opening providing for pivoting of a user's legs into said tub as a user transfers from said toilet seat in said extended use position to said tub seat.

8. A personal hygiene centre of claim 1, wherein said tub has front and back walls and opposing end walls, said door entrance being in said front wall, said seat and back rest being integral with a first of said opposing end walls, said walls being closed in by a ceiling which is sufficient height above a tub floor to accommodate a normal person standing upright on said tub floor, an enlarged opening above said door and extending upwardly to permit attendant access to within said tub when said door is closed, a hand-held shower head being releasably mounted on one of said walls, a flexible water supply hose connecting said hand-held shower head to a source of water in said wall on which said shower head is mounted, said flexible hose being of sufficient length to extend said shower head out to said toilet.

9. A personal hygiene centre of claim 1, wherein said door sealing means is positioned between an edge of said door and opposing edge portion of said front wall adjacent said door, said sealing means being an expandable tube which is expanded to seal a space between said door edge and said front wall edge when said door is in a closed position, means for delivering a pressurized fluid into said tube for expanding same, said delivery means being powered by water pressure from a pressurized water supply.

10. A personal hygiene centre of claim 9, wherein said tube is connected to said door edge, said delivery means being positioned within said door and said tube being in communication with said delivery means, said delivery means having a plunger for pressurizing fluid for delivery to said tube, said plunger being exposed at an edge of said door, a piston being provided in said front wall and movable outwardly through said front wall edge to contact said plunger in said door, said outward movement of said piston being actuated by water pressure from a pressurized water supply.

11. A personal hygiene centre of claim 10, wherein means for controlling release of pressurized water onto said piston, said control means being actuated when said door is mechanically locked in said closed position.

12. A personal hygiene centre of claim 1, wherein an extendable and flexible pipe interconnects said toilet bowl to a waste pipe, said extendable and retractable pipe collapsing on its length dimension as said toilet moves to said storage position beneath said seat.

* * * * *